US012540790B2

(12) United States Patent
Steele et al.

(10) Patent No.: US 12,540,790 B2
(45) Date of Patent: Feb. 3, 2026

(54) ADJUSTABLE FINGER SUPPORT FOR ARCHERY RELEASE

(71) Applicant: Gregory E. Summers Trust Agreement dated Dec. 8, 2006, Madison Heights, VA (US)

(72) Inventors: Brent Steele, Lynchburg, VA (US); Tristan Mason, Madison Heights, VA (US); Gregory Summers, Amherst, VA (US)

(73) Assignee: Veritas 2, LLC, Madison Heights, VA (US)

( * ) Notice: Subject to any disclaimer, the term of this patent is extended or adjusted under 35 U.S.C. 154(b) by 178 days.

(21) Appl. No.: 18/413,885

(22) Filed: Jan. 16, 2024

(65) Prior Publication Data

US 2025/0231002 A1 Jul. 17, 2025

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | | |
|---|---|---|---|---|
| 8,622,051 | B2 * | 1/2014 | Summers | F41B 5/1469 124/35.2 |
| 9,618,295 | B1 | 4/2017 | Rentz | |
| 10,281,231 | B2 * | 5/2019 | Springer | F41B 5/1469 |
| 11,428,500 | B2 * | 8/2022 | Langley | F41B 5/1469 |
| 11,940,242 | B1 * | 3/2024 | Rentz | F41B 5/1469 |
| 11,994,359 | B2 * | 5/2024 | Springer | F41B 5/1469 |

* cited by examiner

*Primary Examiner* — John A Ricci
(74) *Attorney, Agent, or Firm* — Leading Edge Law Group, PLC

(57) ABSTRACT

An adjustable finger support for an archery release includes a handle portion having a longitudinal axis, top and bottom portions and interior and exterior side surfaces. A finger bed is pivotally connected with the handle portion for movement about a pivot axis at the top of the finger bed parallel to the longitudinal axis. Preferably, the finger bed is arranged in a recess in the handle portion exterior side surface for pivotal movement therein relative to the handle portion. The bottom portion of the finger bed is spaced from the handle portion at an angle desired by the archer and locked into place. Angular adjustment provides an optimal fit for the archer and better positions a head portion of the archery release toward a target.

17 Claims, 9 Drawing Sheets

ADJUSTABLE FINGER SUPPORT FOR ARCHERY RELEASE

BACKGROUND OF THE INVENTION

Release devices are used in archery to assist the archer in pulling a bowstring to a fully drawn position and then releasing the bowstring to fire an arrow. Some release devices use grippers for engaging a bowstring or a nock mounted on the bowstring. Other release devices use a rope looped around the bowstring. Handheld releases are generally of two types, using either a trigger or back tension to fire the shot.

The present invention relates to an archery release, and more particularly to a handheld archery release which includes adjustable finger beds.

BRIEF DESCRIPTION OF THE PRIOR ART

Virtually all handheld archery releases include a handle which is configured for gripping by the archer. Usually, the handle is gripped by the index and middle fingers of the archer, with the fingers being supported by contoured finger beds in an upper surface of the handle. It is known in the art to provide a handheld archery release with radially adjustable finger pieces as disclosed in U.S. Pat. No. 9,618,295. However, the side portions of the release handle are generally fixed which inhibits repeatable finger bed placement by the archer which limits accuracy of a shot. The present invention was developed in order to overcome the drawbacks of existing handheld releases by providing angularly adjustable finger beds in the side walls of an archery release handle. The angular adjustability allows the head of the release to be pointed toward a target from an axis that is perpendicular to the radial finger adjustability of prior handheld archery releases.

SUMMARY OF THE INVENTION

Accordingly, it is a primary object of the invention to provide an improved handle for an archery release. The handle is preferably formed of two mating handle portion which are joined together. Each handle portion has a longitudinal axis, top and bottom portions, and exterior and interior side surfaces between the top and bottom portions. The top portion contains at least one concave surface which acts as a finger bed to support a finger of an archer. A finger bed is pivotally connected at one end with the handle top portion for rotation about a pivot axis parallel to the handle longitudinal axis for movement of the other end of the finger bed toward and away from the handle portion to a desired position. Preferably, the finger bed is arranged in a first recess in an exterior side surface of each handle portion and includes a pair of first projections extending in opposite directions from a top portion of the finger bed which are arranged in corresponding openings in the handle portion for rotation therein. Thus, the angle of the finger bed relative to the handle portion can be adjusted as desired by the archer for an optimal fit and to better position a head portion of the archery release toward a target.

The finger bed preferably contains a tapered recess in an outer side surface thereof to improve the ergonomics of the handle. The depth of each tapered recess decreases toward the finger bed bottom portion. Similarly, the length of each tapered recess further decreases toward the finger bed bottom portion. The upper portion of the tapered recess extends a length equal to the longitudinal length of the concave surface.

According to a preferred embodiment, the finger bed includes a second projection extending from a bottom portion thereof in the direction toward the handle portion. The handle portion contains an opening configured to receive the second projection. A locking screw is arranged in the handle and is operable to lock and release the finger bed second projection to retain the finger bed in a selected angular position.

According to an alternate embodiment, the finger bed includes top and bottom portions corresponding with the top and bottom portions of the handle portion and a projection which extends outwardly from an edge thereof to define a channel within the finger bed intermediate the finger bed top and bottom portions. A drive assembly includes a link having a boss which is displaceable within the finger bed channel to pivot the finger bed about the pivot axis relative to the handle portion.

The drive assembly further includes a screw rotatably connected with the handle portion and threadably connected with the link. Rotation of the screw in a first direction displaces the link within the finger bed channel toward an open end of the channel and rotation of the screw in a second direction displaces the link within the channel toward a closed end thereof to adjust the angle of the finger bed relative to the handle portion.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
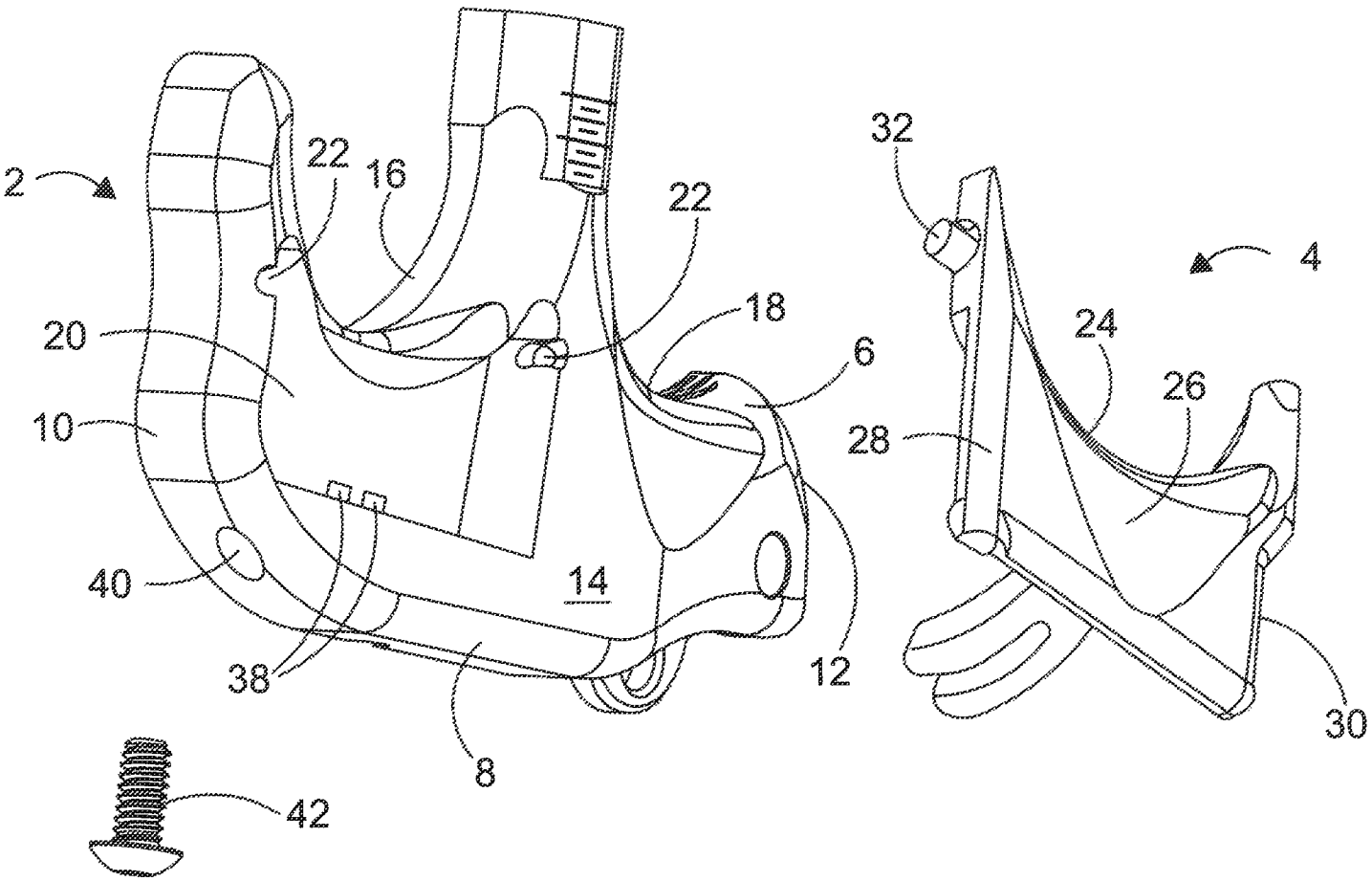
FIG. 1 is an exploded perspective view of an adjustable finger bed and handle of an archery release according a first embodiment of the invention.

A preferred embodiment of a handheld archery release having an angularly adjustable finger bed according to the invention is shown in FIG. 1. The release includes a handle which preferably is formed of two concave handle portions or sections 2, one of which is shown in FIG. 1. The handle portions are configured to be joined in a mating fashion by screws or the like, not shown, to form a handle assembly having a longitudinal axis as is known in the art. The release also includes a finger bed 4 pivotally connected with the handle portion as will be described below.

Figure 2:
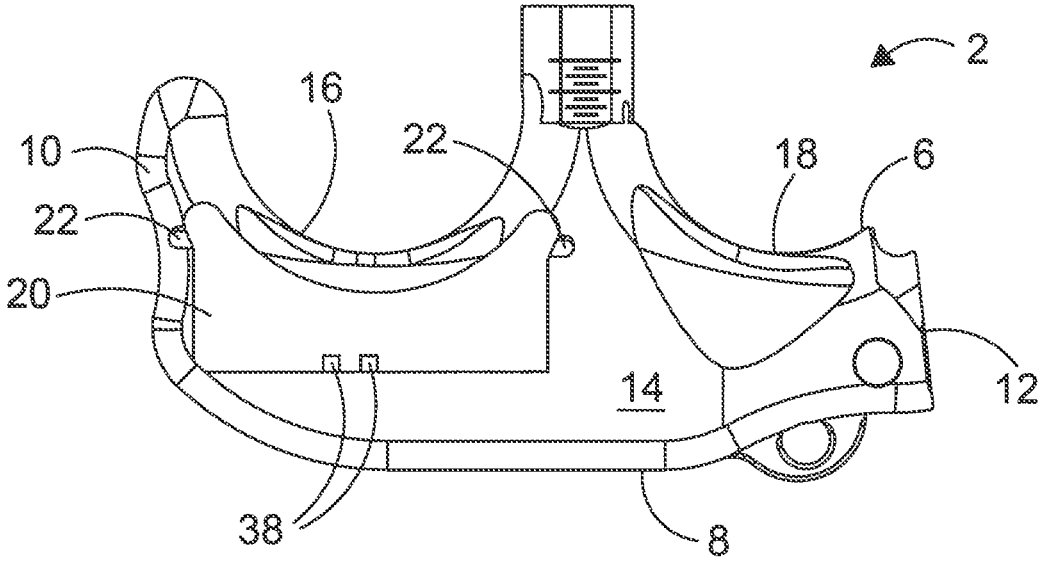
FIG. 2 is a front view of the handle portion of FIG. 1.
Figure 3A:
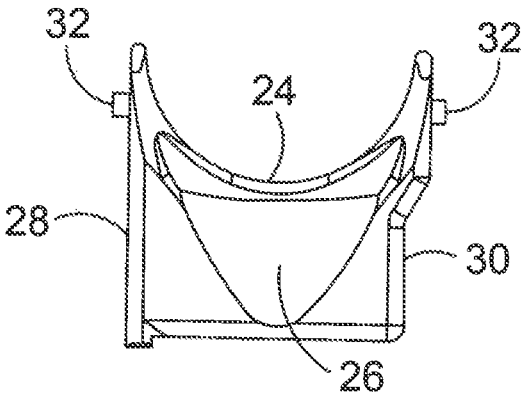
FIGS. 3*a*, 3*b*, 3*c* and 3*d* are front rear, left side and top views, respectively, of the finger bed of FIG. 1.
Figure 3B:
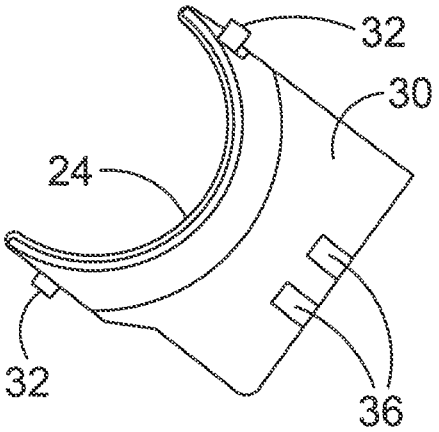
Figure 3C:
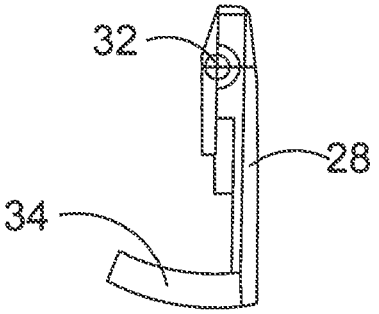
Figure 3D:
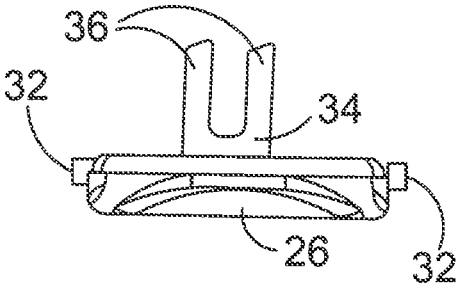

The handle portion 2 is shown in more detail in FIG. 2. It includes top 6, bottom 8, front 10 and rear 12 portions and exterior 14 and interior (not shown) side surfaces. The top portion 6 of the handle contains front 16 and rear 18 spaced contours having a concave configuration, each of the contours supporting a finger of an archer when the archery release is in use. Preferably, the front contour supports the index finger of the archer and the rear contour supports the middle finger of the archer. Below the front contour 16, the exterior surface 14 of the handle portion contains a recess 20 in which an adjustable finger bed 4 is arranged. At the front and rear portions of the top portion of the recess, the handle portion contains notches or second recesses 22 to support the finger bed.

The finger bed 4 is shown in detail in FIGS. 3*a*-3*d*. It has a generally rectangular configuration with a concave upper surface 24 corresponding with the front contour of the handle portion. That is, the concave surfaces of the finger bed and the front contour of the handle portion are aligned. The front surface of the finger bed contains a tapered recess 26 extending from the concave upper surface toward the bottom portion of the finger bed. Preferably, the tapered recess terminates short of the bottom portion. The depth of the tapered recess decreases from the top portion to the bottom portion and the longitudinal length of each tapered recess also decreases in the direction of the bottom portion. Preferably, the length of the upper portion of each tapered recess extends a longitudinal length equal to the longitudinal length of the front contour of the handle portion. The tapered recess thus has a scalloped configuration.

The finger bed further includes front 28 and rear 30 surfaces. At the top portion of these surfaces, a pair of nubs or stubs 32 extend along a finger bed axis parallel to the longitudinal axis of the handle. The stubs are configured to fit within the corresponding recesses 22 in the handle portion to swing freely within the recesses so that the finger bed pivots about the finger bed axis. As such, the top portion of the finger bed is retained in the recess 20 of the handle portion while the bottom portion of the finger bed moves toward or away from the handle portion.

The finger bed 4 further includes a projection 34 which extends rearwardly from a bottom portion thereof toward the handle portion. The projection preferably curves upwardly and includes a spaced pair of wings or prongs 36 defining a gap therebetween. The handle portion 2 contains a pair of openings 38 in the recess 20 to receive the prongs. The prongs extend freely through the respective openings during pivotal movement of the finger bed relative to the handle portion. However, a locking mechanism is provided to lock the finger bed in a selected angular orientation relative to the handle portion as selected by the archer.

One example of a locking mechanism is shown in FIG. 1. The handle portion 2 contains a threaded opening 40 configured to receive a screw 42. The end of the screw within the handle is configured to engage the finger bed projection 34. When the screw is tightened, it presses against the finger bed projection and locks it in place relative to the handle openings, thereby locking the finger bed in a selected angular position. Where the projection is configured with the wings as shown in the drawing, the screw engages the prongs in the gap therebetween.

In operation, the archer turns the screw 42 in a direction to release it from the finger bed projection. The archer then manually pivots the finger bed to a desired angle relative to the handle portion. Once positioned, the screw is then tightened against the finger bed projection to lock the finger bed in position.

Referring now to FIGS. 4-9, an alternate embodiment of an archery release with an angularly adjustable finger bed will be described. This embodiment also includes a handle portion 102 and finger bed 104 pivotally connected with the handle portion. The handle portion is shown in detail in FIGS. 5*a*-5*c* and the finger bed in shown in detail in FIGS. 6*a*-6*h*.

The handle portion 102 is similar to the handle 2 of the preferred embodiment and includes top 106, bottom 108, front 110 and rear 112 portions and exterior 114 and interior (not shown) side surfaces. The top portion 106 contains front 116 and rear 118 spaced contours having a concave configuration to support the index and middle fingers, respectively, of the archer. Below the front contour 116, the handle portion exterior surface 114 of the handle portion contains a recess 120 in which the finger bed 104 is arranged. The handle portion further contains notches or second recesses 122 to support the finger bed.

The finger bed 104 differs somewhat from the finger bed 4 of the preferred embodiment. It has a generally triangular configuration with a concave upper surface 124 corresponding with the front contour of the handle portion. The front surface of the finger bed contains a tapered recess 126 extending from the concave upper surface toward the bottom portion of the finger bed. The finger bed further includes left side 128 and right side 130 surfaces from which a pair of nubs or stubs 132, respectively, extend along a finger bed axis parallel to the longitudinal axis of the handle. The stubs are configured to fit within the corresponding recesses 122 in the handle portion to swing freely within the recesses so that the finger bed pivots about the finger bed axis toward or away from the handle portion.

The finger bed 104 further includes a tab or projection 134 which extends outwardly from the left side surface 128 to define a channel 144 intermediate the top and bottom portions thereof. A drive assembly for pivoting the finger bed relative to the handle portion is arranged in handle portion.

Figure 7C:
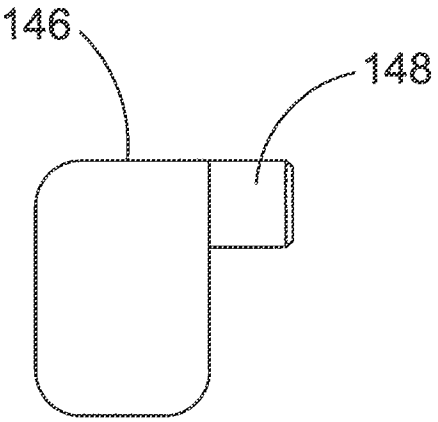
FIGS. 7*a*, 7*b*, and 7*c* are top perspective, rear perspective and top views, respectively, of a drive link for the second embodiment of FIG. 4.
Figure 7B:
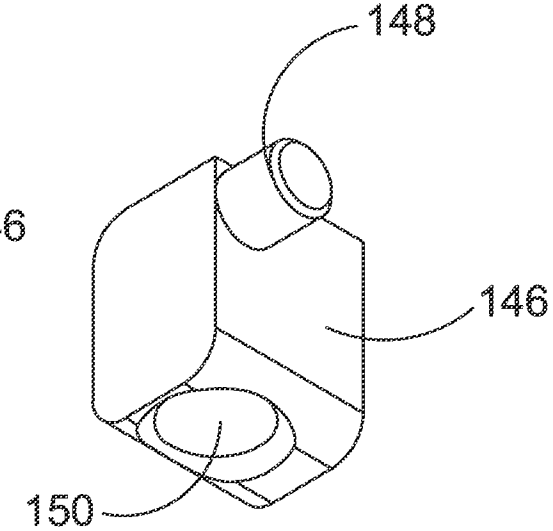
Figure 7A:
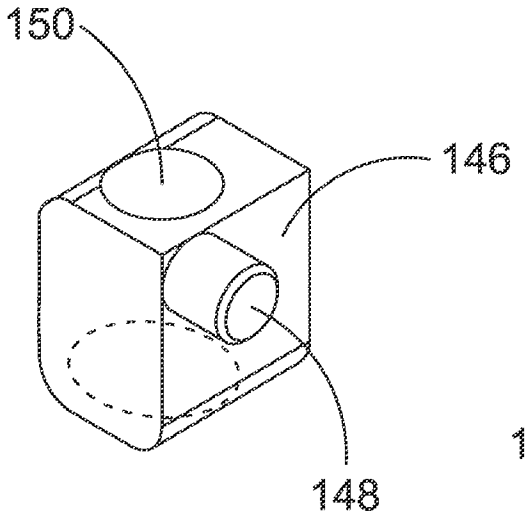

The drive assembly includes a link 146 which is shown in FIGS. 7*a*-7*c*. The link is generally cubicle and includes a boss 148 extending from a side surface thereof. The link further contains a threaded opening 150 extending between the top and bottom surfaces thereof.

Figure 4:
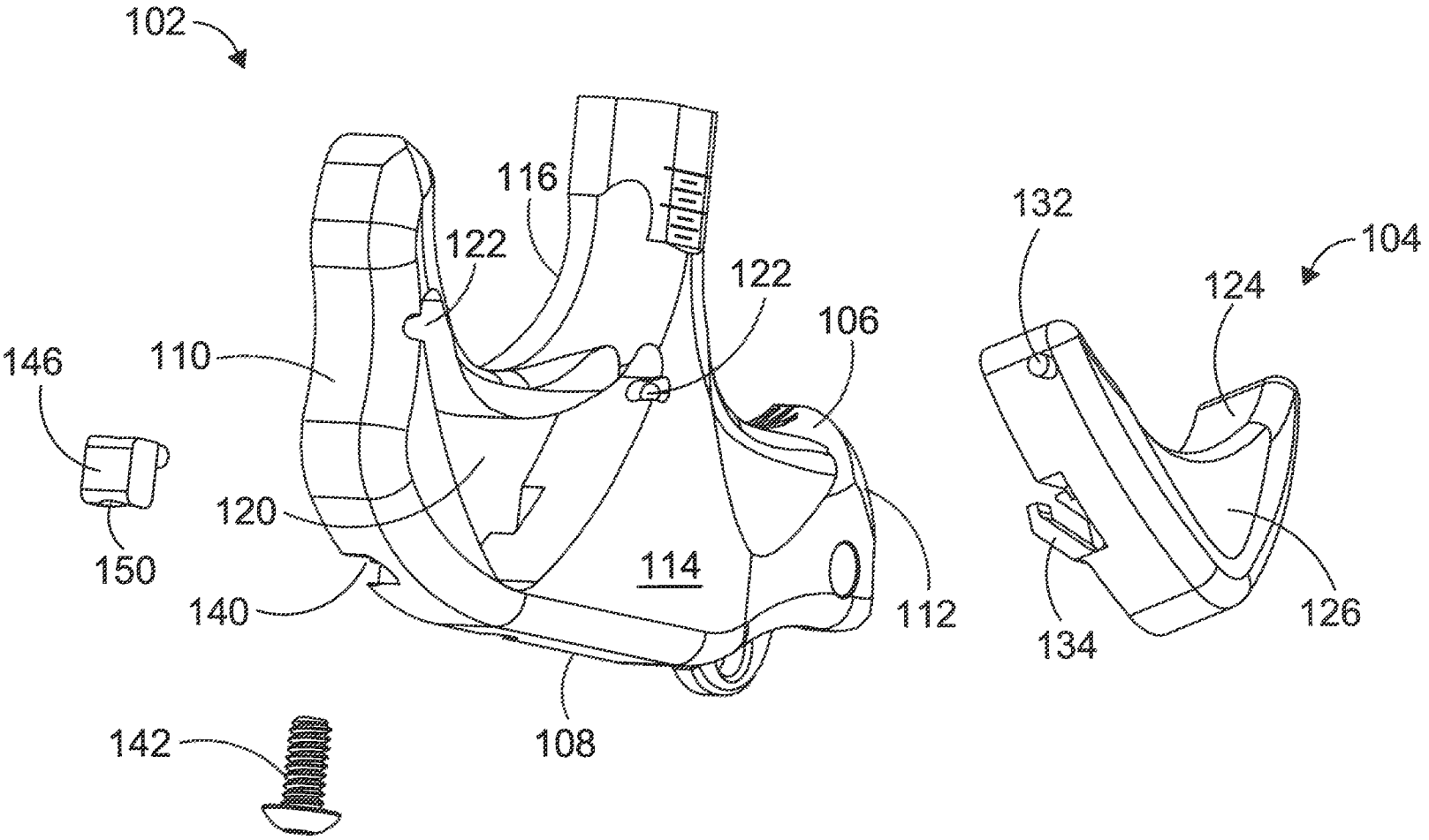
FIG. 4 is an exploded perspective view of an adjustable finger bed and handle of an archery release according a second embodiment of the invention.
Figure 5A:
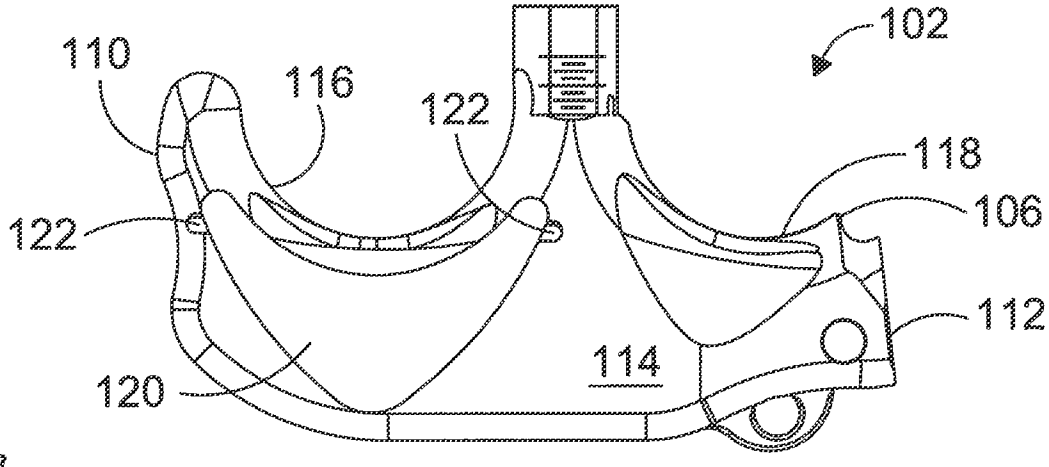
FIGS. 5*a*, 5*b*, and 5*c* are front, rear, and rear perspective views, respectively, of the handle portion of FIG. 4.
Figure 5C:
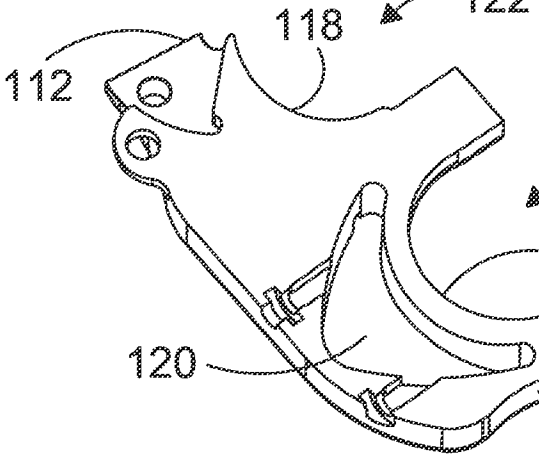
Figure 5B:
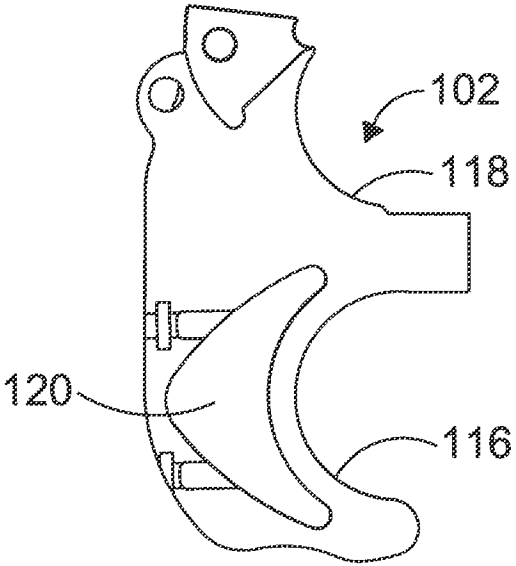
Figure 6B:
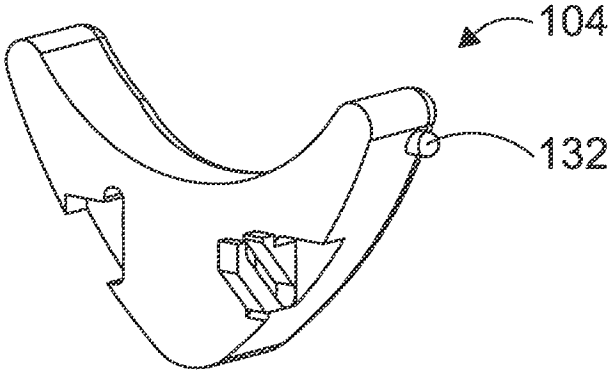
FIGS. 6*a*, 6*b*, 6*c*, 6*d*, 6*e*, 6*f*, 6*g*, 6*h* and 6*i* are rear right perspective, rear left perspective, front right perspective, front left perspective, front, rear, right side, left side, and bottom views, respectively, of the finger bed of FIG. 4.
Figure 6A:
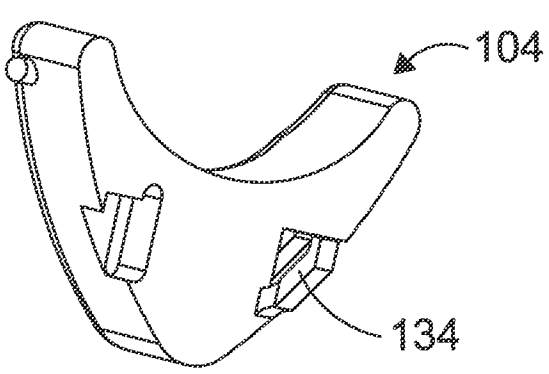
Figure 6D:
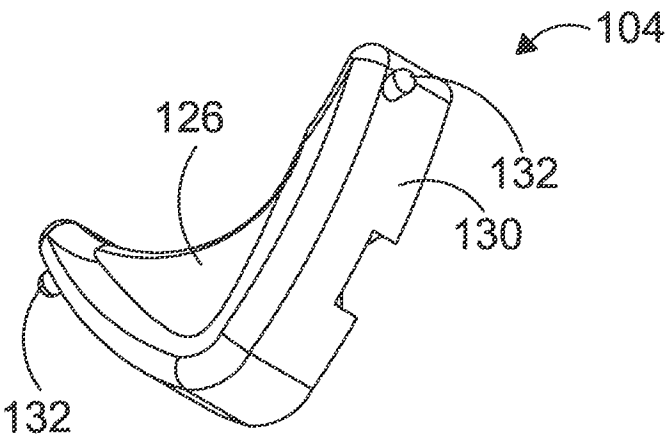
Figure 6C:
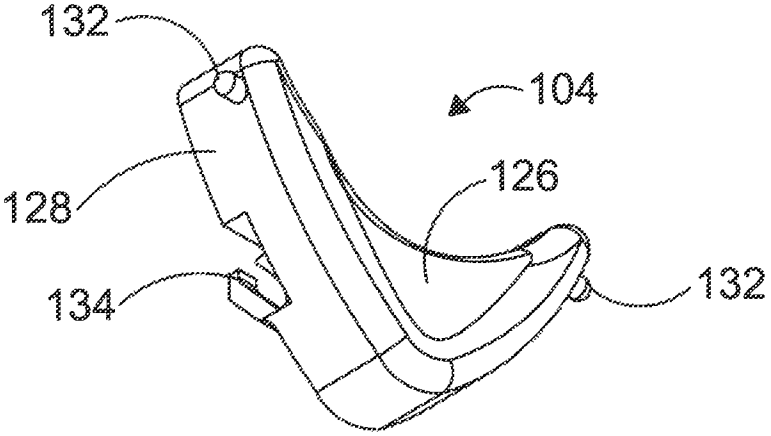
Figure 6G:
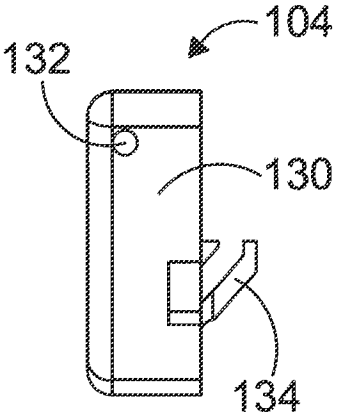
Figure 6F:
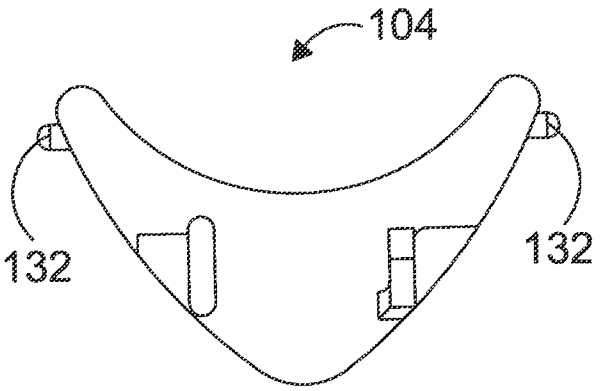
Figure 6E:
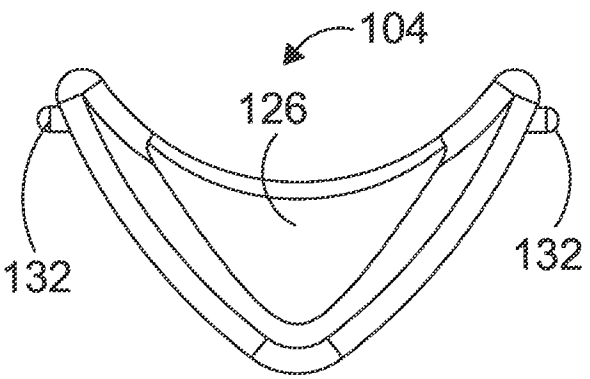
Figure 6I:
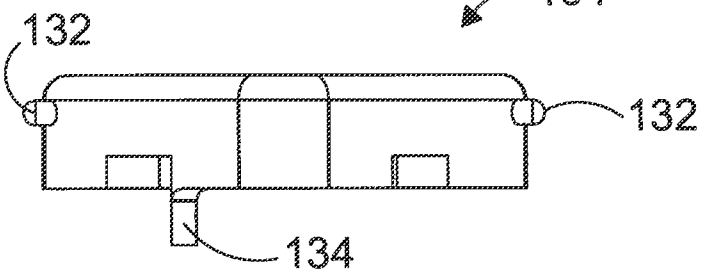
Figure 6H:
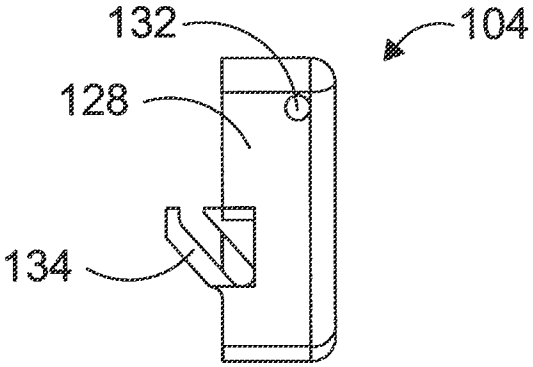
Figure 9:
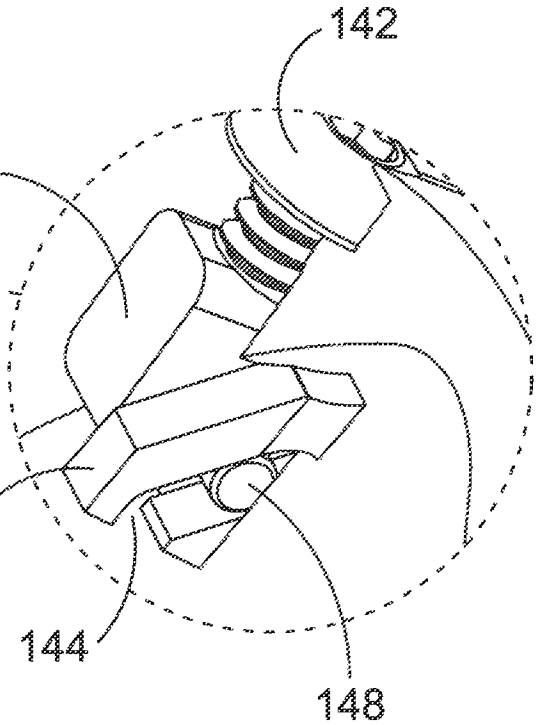
FIG. 9 is a detailed view of the portion of the handle of FIG. 8 taken along line 9-9.
Figure 8:
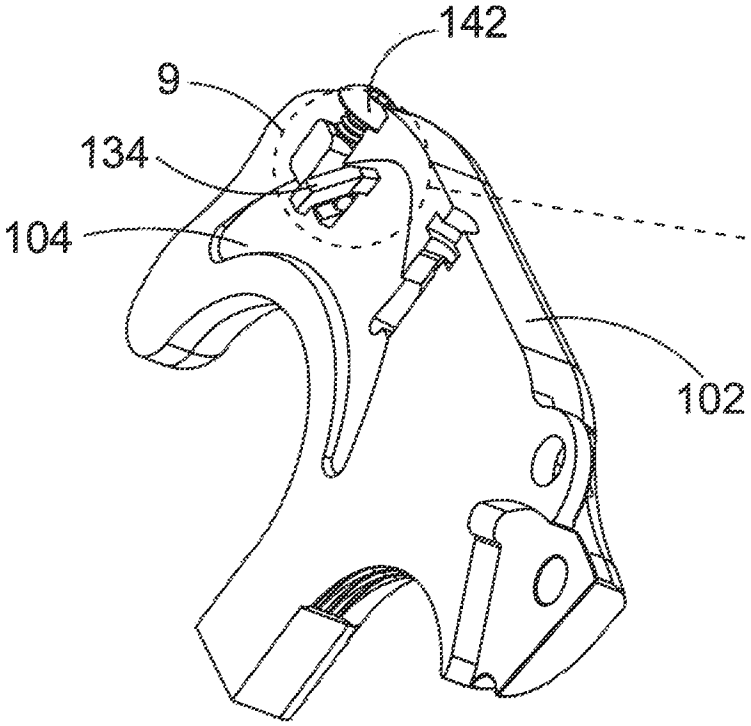
FIG. 8 is a bottom perspective view of the handle of FIG. 4.

As shown in FIGS. 8 and 9, the link projection extends into the channel 144 and engages an inner surface of the projection. The handle portion contains an opening 140 generally at the intersection of the bottom portion 108 and the front of the handle portion as shown in FIG. 4. A screw 142 is arranged in the opening 140 and is threadably connected with the threaded opening 150 in the link 146. Rotation of the screw in opposite directions displaces the link up and down within the handle. More particularly, as the drive link moves up and down, the boss on the drive link rides along tangent to the projection on the rear surface of the finger bed. This displaces the bottom portion of the finger bed causing the angle of the finger bed to change as the projection is driven by the drive link. Thus, the angular orientation of the finger bed relative to the handle can be set by the archer by rotating the screw in the appropriate direction until the desired angle is obtained.

Figure 10B:
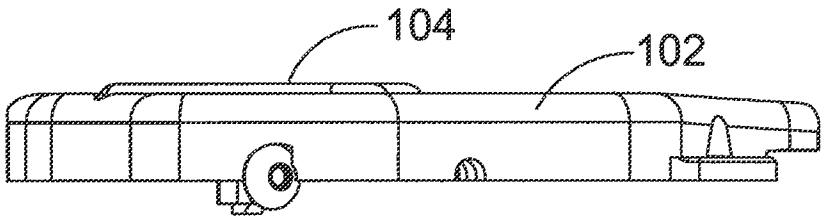
FIGS. 10*a* and 10*b* are bottom views of the handle portion of FIG. 4 angled upwardly and downwardly, respectively, with the finger bed in a retracted position.
Figure 11B:
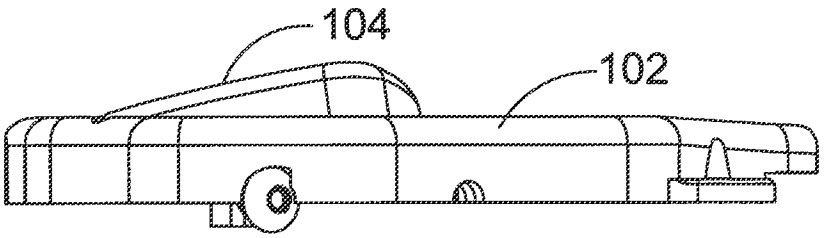
FIGS. 11*a* and 11*b* are bottom views of the handle portion of FIG. 4 angled upwardly and downwardly, respectively, with the finger bed in an angularly extended position.
Figure 10A:
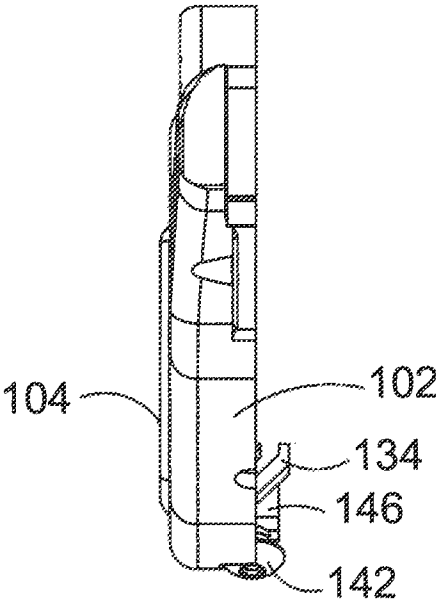
Figure 11A:
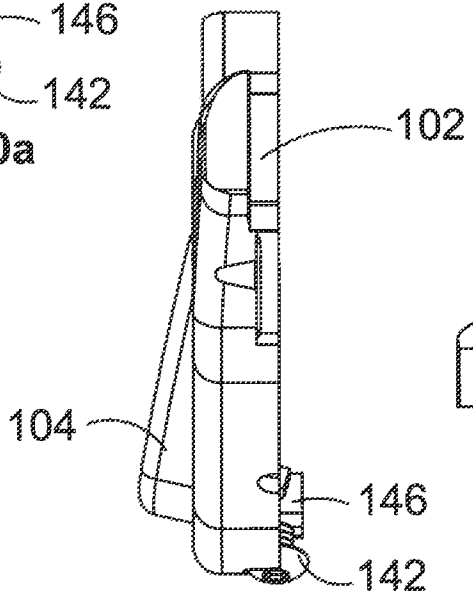

FIGS. 10*a* and 10*b* show the finger bed in a retracted position generally parallel to the handle portion while FIGS. 11*a* and 11*b* show the finger bed in an extended position at an angle relative to the handle portion.

While the preferred forms and embodiments of the invention have been illustrated and described, it will become apparent to those of ordinary skill in the art that various changes and modifications may be made without deviating from the inventive concepts set forth above.

What is claimed is:

1. An adjustable finger support for an archery release, comprising (a) a handle portion of an archery release having a longitudinal axis, top and bottom portions, and exterior and interior side surfaces; and (b) a finger bed pivotally connected at one end with said handle portion for pivotal movement of an other end of said finger bed toward and away from said handle portion in a direction normal to the longitudinal axis to a desired position to support a finger of an archer for operation of the archery release, whereby a head portion of the release may be positioned toward a target.

2. An adjustable finger support as defined in claim 1, wherein said handle portion exterior side surface contains a first recess, said finger bed being arranged in said first recess.

3. An adjustable finger support as defined in claim 2, wherein said handle portion contains a pair of further recesses in said top portion at opposite ends of said first recess and said finger bed includes a pair of first projections arranged in said second recesses to define a pivot axis for said finger bed which extends parallel to said longitudinal axis.

4. An adjustable finger support as defined in claim 3, wherein said first projections are arranged in a top portion of said finger bed, said finger bed including a second projection extending from a bottom portion thereof in a direction toward said handle portion.

5. An adjustable finger support as defined in claim 4, wherein said handle portion contains an opening configured to receive said finger bed second projection during pivotal movement of said finger bed.

6. An adjustable finger support as defined in claim 5, wherein said handle portion includes a locking mechanism which is configured to lock said finger bed at a selected angle relative to said handle portion, whereby said finger bed may be positioned by an archer to a selected angular position for operation of the release.

7. An adjustable finger support as defined in claim 6, wherein said handle portion opening has a threaded configuration and said locking mechanism comprises a screw arranged in said handle portion threaded opening and abuts against said finger bed projection to fix said projection in a selected position relative to said handle portion.

8. An adjustable finger support as defined in claim 7, wherein said second projection comprises a pair of spaced parallel prongs which define a gap therebetween and configured to receive said screw.

9. An adjustable finger support as defined in claim 7, wherein said second projection has a curvature extending toward said finger bed top portion.

10. An adjustable finger support as defined in claim 7, wherein said finger bed contains a tapered recess in an outer side surface thereof.

11. An adjustable finger support as defined in claim 10, wherein said handle portion top portion has a concave surface for supporting an index finger of the archer, said finger bed tapered recess extending from said handle portion concave surface toward a bottom portion of said finger bed.

12. An adjustable finger support as defined in claim 10, wherein said tapered recess has a depth which decreases toward said finger bed bottom portion and a length which decreases toward said finger bed bottom portion.

13. An adjustable finger support as defined in claim 1, wherein said finger bed includes top and bottom portions corresponding with said top and bottom portions of said handle portion and further includes a projection extending outwardly from an edge thereof to define a channel within said finger bed intermediate said finger bed top and bottom portions, and further comprising a drive assembly including a link having a boss which is displaceable within said channel to pivot said finger bed about said pivot axis relative to said handle portion.

14. An adjustable finger support as defined in claim 13, wherein said drive assembly further comprises a screw rotatably connected with said handle portion and threadably connected with said link, rotation of said screw in a first direction displacing said link within said channel toward an open end of said channel and rotation of said screw in a second direction displacing said link within said channel toward a closed end thereof to adjust the angle of said finger bed relative to said handle portion.

15. An adjustable finger support as defined in claim 14, wherein said finger bed contains a tapered recess in an outer side surface thereof.

16. An adjustable finger support as defined in claim 15, wherein said handle portion top portion has a concave surface for supporting an index finger of the archer, said finger bed tapered recess extending from said handle portion concave surface toward a bottom portion of said finger bed.

17. An adjustable finger support as defined in claim 16, wherein said tapered recess has a depth which decreases toward said finger bed bottom portion and a length which decreases toward said finger bed bottom portion.

* * * * *